US007954245B2

(12) United States Patent
Chen

(10) Patent No.: US 7,954,245 B2
(45) Date of Patent: Jun. 7, 2011

(54) HAIR THINNING SCISSORS

(76) Inventor: Chih-I Chen, Taipei (TW)

( * ) Notice: Subject to any disclaimer, the term of this patent is extended or adjusted under 35 U.S.C. 154(b) by 240 days.

(21) Appl. No.: 12/429,185

(22) Filed: Apr. 24, 2009

(65) Prior Publication Data

US 2010/0269354 A1 Oct. 28, 2010

(51) Int. Cl.
*B26B 13/08* (2006.01)

(52) U.S. Cl. ..... 30/195; 30/233.5

(58) Field of Classification Search ..... 30/195, 30/233, 233.5, 254
See application file for complete search history.

(56) References Cited

U.S. PATENT DOCUMENTS 1,903,257 A * 3/1933 Dahl ..... 30/230
5,107,591 A * 4/1992 Sato ..... 30/195
6,141,877 A * 11/2000 Suetsugu ..... 30/195
6,385,851 B2 * 5/2002 Yeh ..... 30/195
6,651,345 B1 * 11/2003 Adachi ..... 30/195
7,159,321 B2 * 1/2007 Yeh ..... 30/195

FOREIGN PATENT DOCUMENTS

DE 3603036 A1 * 8/1986
GB 2 153 732 A * 8/1985

* cited by examiner

*Primary Examiner* — Hwei-Siu C Payer

(57) ABSTRACT

A hair thinning scissors is provided. The hair thinning scissors includes a first cutting edge and a second cutting edge. The first cutting edge is configured with a plurality of arc shaped cutting teeth. A notch is configured between each two neighboring cutting teeth. Each of the arcuate cutting teeth has a radian by the pivotal axis of the first cutting edge and the second cutting edge as an arc center, and a distance from the pivotal axis to the tooth as an arc radius, so that when the first cutting edge and the second cutting edge are actuated to rotate one toward another, each of the cutting teeth moves along a tangent of the arc form of the cutting tooth, thus achieving a more smoothly shearing operation.

4 Claims, 6 Drawing Sheets

HAIR THINNING SCISSORS

BACKGROUND OF THE INVENTION

1. Field of the Invention

The present invention relates to a haircutting scissors.

2. The Prior Arts

A barber may use different kinds of scissors for haircutting. For example, a scissors as shown in FIG. 4 is an instrument specifically designed for thinning hairs. This scissors includes a first cutting edge A and a second cutting edge B pivotally jointed each other. The first cutting edge A is configured with a plurality of straight grating formed cutting teeth A1. Each cutting tooth A1 has a tooth blade A11 configured at an end of the cutting tooth A1, and a notch is defined by each two neighboring teeth. The second cutting edge B has a sharp blade B1 longitudinally configured along one side of the second cutting edge B. When the first cutting edge A and the second cutting edge B are actuated to move toward each other, the sharp blade B1 of the second cutting edge B and the tooth blades A11 of the cutting teeth A1 collaborately scissor to cut matters provided therebetween. When the first cutting edge A and the second cutting edge B are completely closed, the second cutting edge B does not reach bottoms of notches, so that a part of hairs being cut remain uncut in the notches. In such a way, only some of the hairs being cut are really sheared off, thus the hairs are thinned as desired.

Currently, every conventional scissors is operated by actuating two cutting edges to rotate one toward another pivoting at a pivotal axis. The two cutting edges are actuated to move with arcuate tracks. As discussed above, the cutting teeth A1 are straight grating formed as shown in FIG. 4, and therefore the cutting teeth A1 are configured substantially perpendicular with the cutting edge A, and the tooth blades A11 are configured substantially parallel with the first cutting edge A. As such, when the cutting teeth A1 and the second cutting edge collaborately shear the hairs, there is an angle between the cutting teeth A1 and the sharp blade B1 of the second cutting edge B, so that the hairs being cut are likely to slide away from the between of the teeth blades A11 and the sharp blade B1.

Further, a hair thinning scissors is featured in that a part of the hairs being cut fall in the notches, so as to be not cut during the cutting operation. However, the second cutting edge B of the conventional scissors is designed with a consecutively functioning sharp blade B1, so that when the conventional scissors is to be released and taken off from the hairs, the part of uncut hairs are often adversely damaged by the sharp blade B1 of the second cutting edge B.

SUMMARY OF THE INVENTION

A primary objective of the present invention is to provide a hair thinning scissors for eliminating the difficulty of the conventional hair thinning scissors which teeth are straight formed and cause unsmooth cutting operation.

A further objective of the present invention is to provide a hair thinning scissors for eliminating the difficulty of the conventional hair thinning scissors which teeth are straight formed and cause the hair slipping away from the sharp blade.

A still further objective of the present invention is to provide a hair thinning scissors for eliminating the difficulty of the conventional hair thinning scissors which second cutting edge is configured with a consecutively functioning sharp blade, so that when taking off the scissors from the hairs, the uncut hairs are often damaged by the sharp blade.

For achieving the foregoing objectives and others, the present invention provides a hair thinning scissors including a first cutting edge and a second cutting edge. The first cutting edge is configured with a plurality of arc shaped cutting teeth. A notch is configured between each two neighboring cutting teeth. Each of the arcuate cutting teeth has a radian by the pivotal axis of the first cutting edge and the second cutting edge as an arc center, and a distance from the pivotal axis to the tooth as an arc radius, so that when the first cutting edge and the second cutting edge are actuated to rotate one toward another, each of the cutting teeth moves along a tangent of the arc form of the cutting tooth, thus achieving a more smoothly shearing operation.

According to an embodiment of the present invention, each arc shaped cutting tooth of the first cutting edge is configured with a tooth blade and a guiding member. The tooth blade is configured at an end of the tooth and substantially perpendicular with a longitudinal form of the tooth, so that when the first cutting edge meets the second cutting edge for shearing, the tooth blade is positioned substantially parallel with the second cutting edge. The guiding member is configured extending outwardly along the longitudinal form of the tooth and substantially perpendicular with the blade tooth. The guiding member is adapted for guiding the hairs being cut to the tooth blade and securing the hairs thereby for preventing the hairs from sliding away from the tooth blade.

According to another embodiment of the present invention, the second cutting edge is alternatively configured with sharp blades and blunt blades. The sharp blades are distributed corresponding to the tooth blades of the first cutting edge, and the blunt blades are distributed corresponding to the notches of the first cutting edge. In such a way, when the first cutting edge and the second cutting edge are actuated to shear hairs, hairs distributed between the second cutting edge and the cutting teeth are solidly cut, while hairs distributed between the second cutting edge and the notches are not cut and protected by the blunt blades.

Specifically, the hair thinning scissors includes a first cutting edge and a second cutting edge. The first cutting edge and the second cutting edge are pivotally coupled each other at a pivot axle. The first cutting edge and the second cutting edge can be actuated to rotate pivoting at the pivot axle. When the first cutting edge and the second cutting edge rotate toward each other, the hair thinning scissors closes to shear, and when the first cutting edge and the second cutting edge rotate apart from each other, the hair thinning scissors opens to release. The first cutting edge is configured with a plurality of parallel distributed cutting teeth. A notch is defined between each two neighboring cutting teeth. Each of the cutting teeth has two lateral sides configured in an arc form defined by the pivot axle as an arc center and a distance from the pivot axle to the cutting tooth as an arc radius. Each of the cutting teeth has a tooth blade and a guiding member. The tooth blade is configured at an end of the cutting tooth. The guiding member is configured outwardly extending along one lateral side which is more adjacent to the pivot axle and protruding out from the tooth blade. The second cutting edge is configured with a plurality of sharp blades and blunt blades at one side opposite to the first cutting edge. The sharp blades and the blunt blades are alternatively distributed. The sharp blades are distributed corresponding to the tooth blades of the first cutting edge, and the blunt blades are distributed corresponding to the notches of the first cutting edge. In such a way, when the first cutting edge and the second cutting edge are actuated to shear hairs, the sharp blades meet the tooth blades for shearing, while the blunt blades match with the notches for not shearing.

According to an aspect of the present invention, the guiding member configured at each of the cutting teeth is further configured with a guiding slope extending from a free end of the guiding member to the tooth blade of the cutting tooth for more smoothly guiding the hairs to the tooth blade.

According to a further aspect of the present invention, the blunt blades are configured in arc forms, so as to further prevent the damage caused to uncut hairs.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
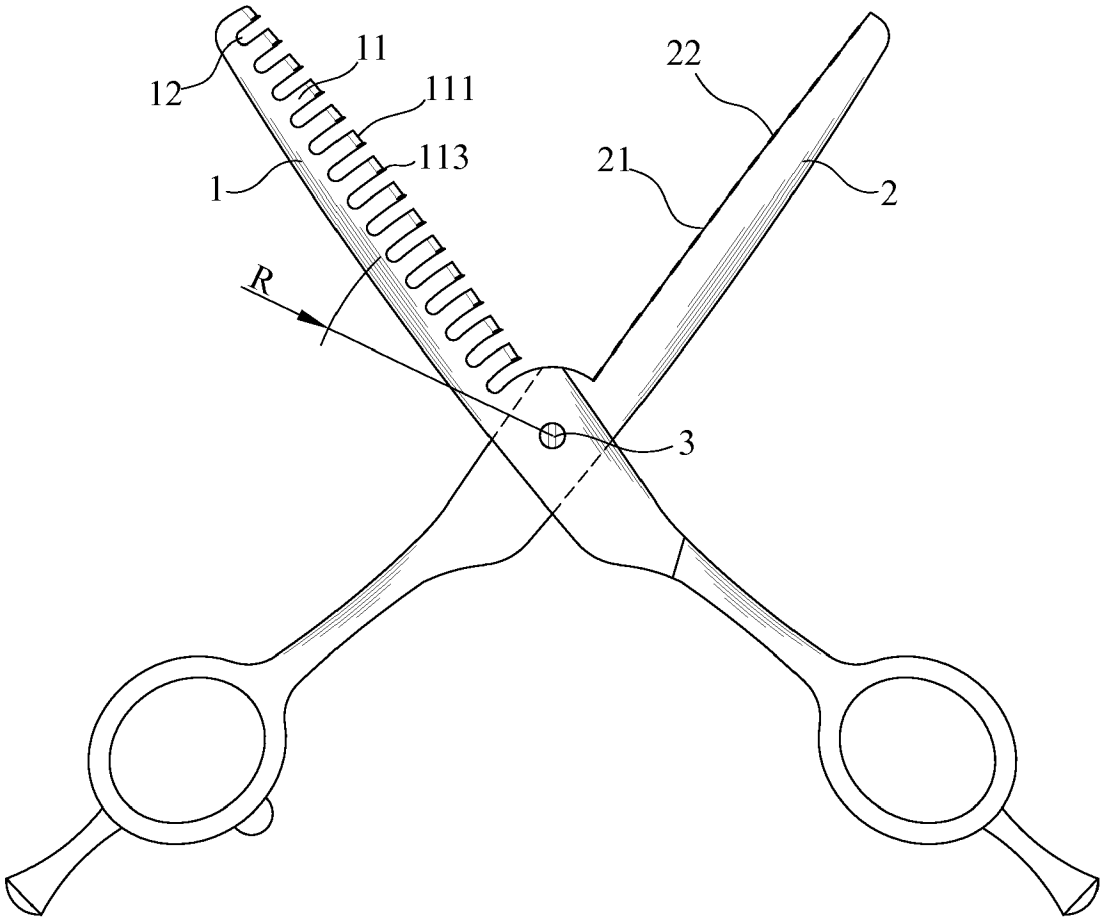
FIG. 1 is a schematic view of a hair thinning scissors in an opening state according to an embodiment of the present invention.
Figure 1A:
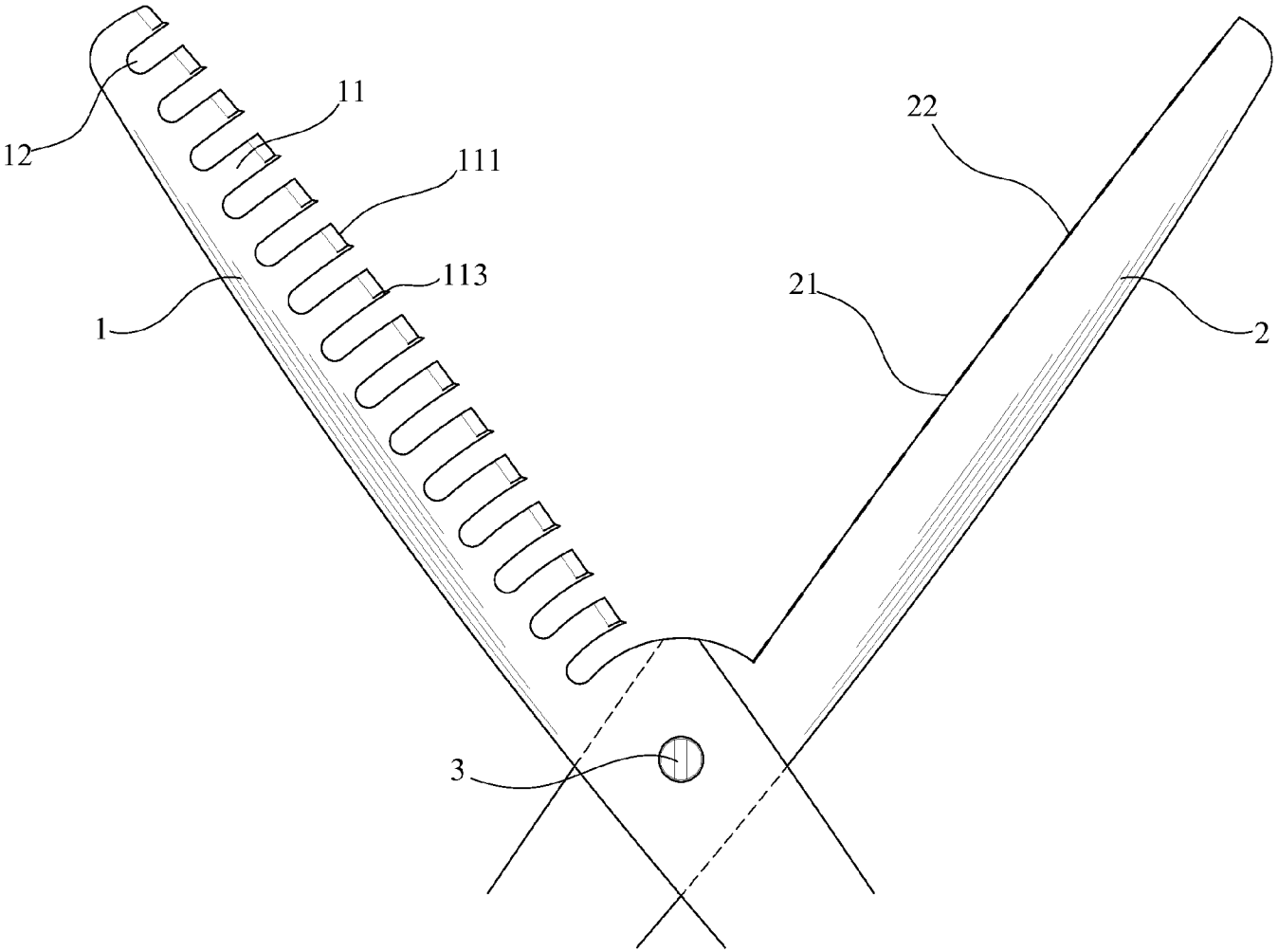
FIG. 1A is a partial enlargement view of FIG. 1.

FIG. 1 is a schematic view of a hair thinning scissors in an opening state according to an embodiment of the present invention, and FIG. 1A is a partial enlargement view of FIG. 1. Referring to FIGS. 1 and 1A, the present invention provides a hair thinning scissors. The hair thinning scissors includes a first cutting edge 1 and a second cutting edge 2. The first cutting edge 1 and the second cutting edge 2 are pivotally coupled each other at a pivot axle 3. The first cutting edge 1 and the second cutting edge 2 are provided with finger holding holes, respectively, at the same side thereof, for allowing a user to rest his thumb and forefinger therein to operate the hair thinning scissors and actuating the first cutting edge 1 and the second cutting edge 2 to rotate to open or close pivoting at the pivot axle 3. The closing operation of the first cutting edge 1 and the second cutting edge 2 performs a shearing/cutting operation. The first cutting edge 1 is configured with a plurality of parallel distributed cutting teeth 11. A notch 12 is defined between each two neighboring cutting teeth 11. Each of the cutting teeth 11 has two lateral sides configured in an arc form defined by the pivot axle 3 as an arc center and a distance from the pivot axle 3 to the cutting tooth 11 as an arc radius R. Each of the cutting teeth 11 has a tooth blade 111 and a guiding member 113. The tooth blade 111 is configured at an end of the cutting tooth 11. The guiding member 113 is configured outwardly extending along one of the two lateral sides of the cutting tooth 11 which is more adjacent to the pivot axle 3 and protruding out from the tooth blade 111.

The second cutting edge 2 is configured with a plurality of sharp blades 21 and blunt blades 22 at one side opposite to the first cutting edge 1. The sharp blades 21 and the blunt blades 22 are alternatively distributed. The sharp blades 21 are distributed corresponding to the tooth blades 111 of the first cutting edge 1, and the blunt blades 22 are distributed corresponding to the notches 12 of the first cutting edge 1. Preferably, the blunt blades 22 are ground to achieve an arc configuration, thus avoiding cutting the hairs thereby.

Figure 3:
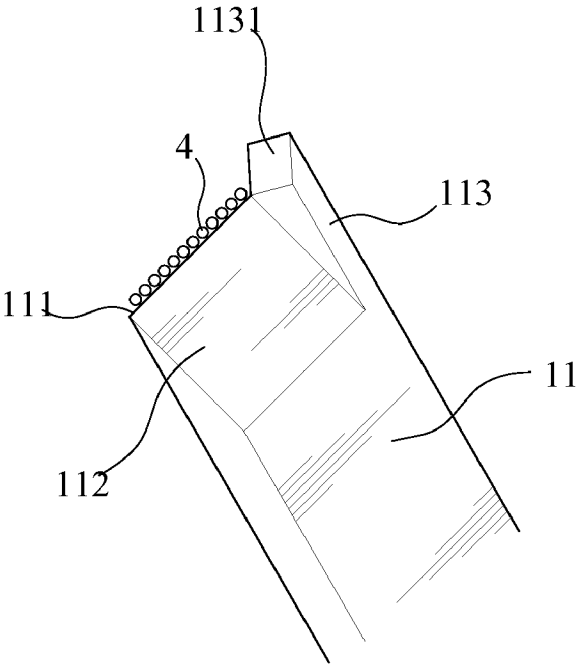
FIG. 3 is a partial perspective view of a structure of a cutting tooth of the first cutting edge.
Figure 3B:
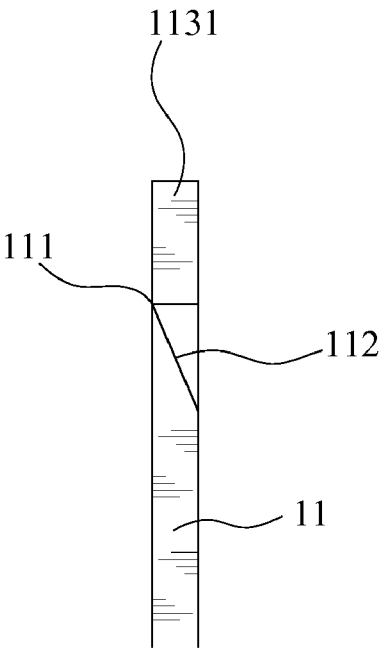
FIG. 3B is a side view of the cutting tooth of FIG. 3.
Figure 3A:
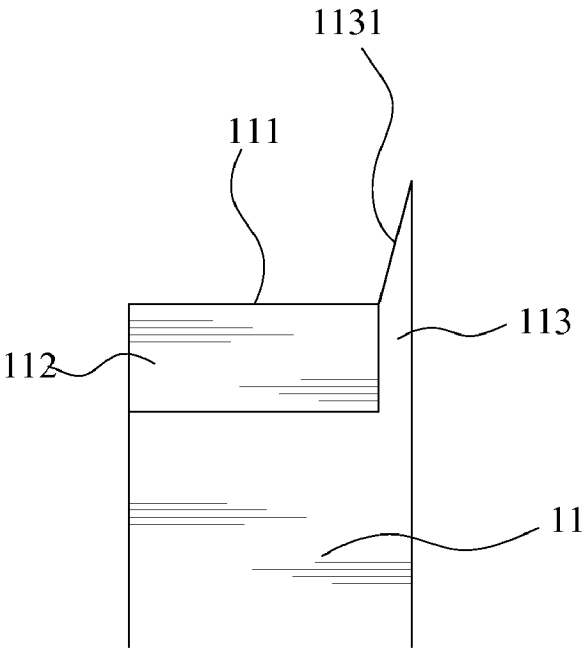
FIG. 3A is a front view of the cutting tooth of FIG. 3.
Figure 4:
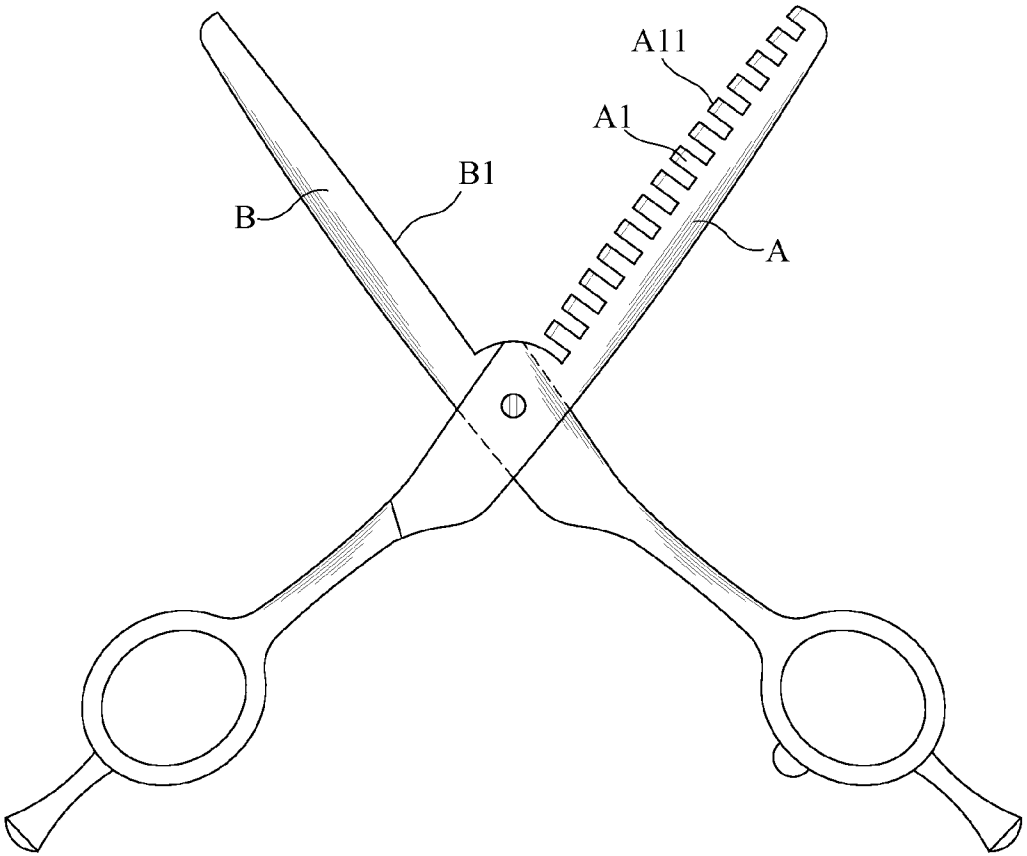
FIG. 4 ( Prior Art )
FIG. 4 is a schematic view of a conventional hair thinning scissors.

FIG. 3 is a partial perspective view of a structure of a cutting tooth of the first cutting edge, and FIG. 3A is a front view of the cutting tooth of FIG. 3, and FIG. 3B is a side view of the cutting tooth of FIG. 3. Referring to FIGS. 3, 3A, and 3B, the structure of each cutting tooth 11 configured on the first cutting edge 1 is configured by grinding a free end of the cutting tooth 11 to obtain a slope 112, while remaining a fringe of the cutting tooth 11 not ground, thus further configuring a guiding member 113 outwardly extending from the tooth blade 111. The guiding member 113 is further ground to configure a guiding slope 1131 extending from the free end to the tooth blade 111. In such a way, when the hair thinning scissors is used for cutting hairs 4, the hairs 4 can be guided by the guiding slope 1131 to the tooth blade 111.

Figure 2:
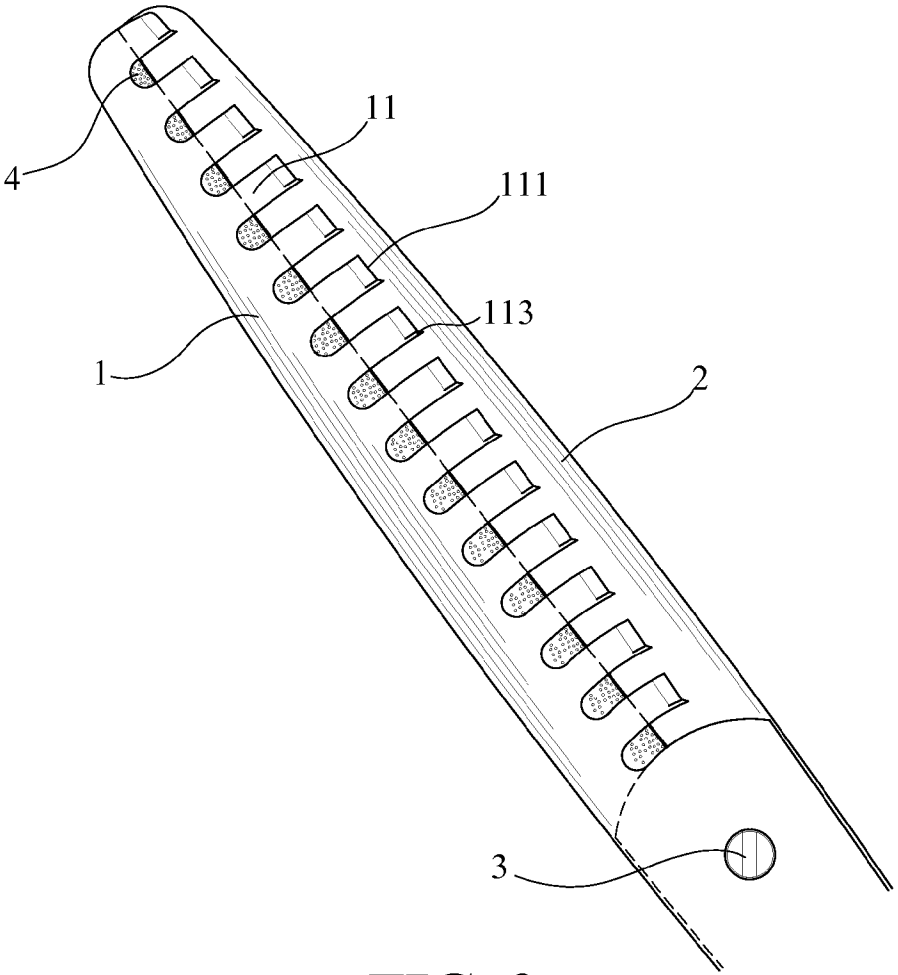
FIG. 2 is a schematic view of the hair thinning scissors being operated in a closing state while remaining a part of hairs in the notches, according to an embodiment of the present invention.

As shown in FIG. 2, when the hair thinning scissors is in operation, the first cutting edge 1 and the second cutting edge 2 are actuated to rotate for shearing the hairs. Hence, a part of the hairs 4 are guided along the guiding slope 1131 of the guiding member 113 to the tooth blades 111, until the sharp blades 21 of the second cutting edge 2 meet the tooth blades 111 and shear the hairs 4 guided thereto. When being sheared by the sharp blades 21 of the second cutting edge 2 and the tooth blades 111, the hairs 4 are stopped by the guiding member 113 from sliding away, thus guaranteeing effect of the shearing operation. When the first cutting edge 1 and the second cutting edge 2 oppositely shear the hairs 4, there are another part of hairs 4 falling in the notch 12 between two neighboring cutting teeth 11. In this case, when the first cutting edge 1 and the second cutting edge 2 close, the blunt blades 22 lock the hairs 4 in the notch 12. Therefore, the user is allowed to move the hair thinning scissors along the direction of the hairs toward tips of the hairs. In such a way, the hairs remain uncut in the notch 12 can be pulled off from the notch 12, and won't be damaged therein.

It should be further noted that although the cutting teeth 11 are defined as having an arc form, this is for guaranteeing that when the first cutting edge 1 and the second cutting edge 2 meet for shearing hairs, the tooth blades 111 are positioned substantially parallel with the sharp blades 21, so as to achieve a better performance of shearing the hairs distributed therebetween. In other embodiment of the present invention, the cutting teeth 11 may be formed in other shapes, while the tooth blades 111 are configured substantially unparallel with an extending direction of the first cutting edge 1, wherein when the first cutting edge 1 and the second cutting edge 2 meet for shearing hairs, the tooth blades 111 are positioned substantially parallel with the sharp blades 21.

In such a way, when the first cutting edge and the second cutting edge are actuated to shear hairs, the sharp blades meet the tooth blades for shearing, while the blunt blades match with the notches for not shearing.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A hair thinning scissors, comprising:

a first cutting edge, having a plurality of parallel distributed cutting teeth configured at one side of the first cutting edge, and notches defined between neighboring cutting teeth, wherein each of the cutting teeth has two lateral sides configured in an arc form defined by a pivot axle as an arc center and a distance from the pivot axle to the cutting tooth as an arc radius, and each of the cutting teeth has a tooth blade and a guiding member, the tooth blade being configured at an end of the cutting tooth, and the guiding member outwardly extending from the tooth blade along one lateral side which is more adjacent to the pivot axle; and a second cutting edge, pivotally coupled to the first cutting edge at the pivot axle, wherein the first cutting edge and the second cutting edge can be actuated to rotate pivotally at the pivot axle, and when the first cutting edge and the second cutting edge rotate toward each other, the hair thinning scissors closes to shear, wherein the second cutting edge is configured with a plurality of sharp blades and blunt blades alternatively distributed at one side opposite to the cutting teeth of the first cutting edge, the sharp blades are distributed corresponding to the tooth blades of the first cutting edge, and the blunt blades are distributed corresponding to the notches of the first cutting edge, so that when the first cutting edge and the second cutting edge are actuated to shear hairs, the sharp blades meet the tooth blades for shearing, while the blunt blades match with the notches for not shearing.

2. The hair thinning scissors according to claim 1, wherein the guiding member further comprises a guiding slope extending from a free end of the guiding member to the tooth blade.

3. The hair thinning scissors according to claim 1, wherein the blunt blades are arc formed.

4. The hair thinning scissors according to claim 2, wherein the blunt blades are arc formed.

* * * * *